US006418939B1

(12) United States Patent
Byun

(10) Patent No.: US 6,418,939 B1
(45) Date of Patent: Jul. 16, 2002

(54) COSMETIC BRUSH

(76) Inventor: Young Kwang Byun, MokdongSinsigaji Apt. 928-1005, 312, Shinjung-dong, Yangchungu, Seoul (KR)

( * ) Notice: Subject to any disclaimer, the term of this patent is extended or adjusted under 35 U.S.C. 154(b) by 0 days.

(21) Appl. No.: 09/731,287

(22) Filed: Dec. 6, 2000

(30) Foreign Application Priority Data

Oct. 7, 2000 (KR) ..... 2000-27962 U

(51) Int. Cl.[7] ..... A45D 40/18

(52) U.S. Cl. ..... 132/313; 401/183; 15/184; 132/317

(58) Field of Search ..... 401/183, 184; 15/184; 132/290, 313, 317, 318, 320

(56) References Cited

U.S. PATENT DOCUMENTS 1,358,597 A * 11/1920 Tobias ..... 132/290
1,865,850 A * 7/1932 Garvey ..... 401/184
2,887,708 A * 5/1959 Kane ..... 401/184
3,167,806 A * 2/1965 Hogan ..... 15/184
4,944,625 A * 7/1990 Futter et al. ..... 401/153
6,039,052 A * 3/2000 Choi ..... 132/313
6,234,181 B1 * 5/2001 Lou ..... 132/313

* cited by examiner

*Primary Examiner*—Eduardo C. Robert
(74) *Attorney, Agent, or Firm*—Weiner & Burt, P.C.; Irving M. Weiner; Pamela S. Burt

(57) ABSTRACT

A cosmetic brush is provided to carry a cosmetic powder therein to, protect the brush from the contamination or the wear-down, and prevent the discharge of the powder while the brush is not in use. The cosmetic brush comprises a cylinder containing the cosmetic powder and having discharge holes on one end; a connect cap being coupled with the cylinder and guiding the discharge of the cosmetic powder through the discharge holes; a pressure pump being screw-coupled with the cylinder to make the cosmetic powder move into the brush by its pumping; a guide tube being coupled with the cylinder, the brush moving therein; a sliding tube having the brush inserted therein and being free to rotate with fitting into the guide tube; a discharge pipe being placed into the brush to uniformly supply the cosmetic powder; and a covering cap for detachably covering the sliding tube to protect the brush.

14 Claims, 4 Drawing Sheets

COSMETIC BRUSH

The present application claims priority from Korean Utility Model Application No. 2000-27962 filed on Oct. 7, 2000.

BACKGROUND OF THE INVENTION

1. Field of the Invention

The present invention relates to a cosmetic brush used in powdering with cosmetics, such as blush or cosmetic powder, and more particularly, to a cosmetic brush for carrying a brush hair and the cosmetic powder together and keeping the brush hair clean and the cosmetic powder unspilled.

2. Description of the Related Art

Generally, a cosmetic brush refers to one of make-up tools, which is used in powdering a skin with cosmetics such as blush or cosmetic powder, and it comprises a brush hair and the cosmetic powder together thereinside to supply the powder to the brush hair without the inconvenience to carrying an extra case of the powder.

As one conventional example for that, the cosmetic brush is shaped to have a brush hair on its tip, an inner case for receiving the cosmetic powder thereinside, and a pressure pump for injecting air to the inner case. It is operated in such a manner that air is injected into the inner case by means of the pressure pump and the powder inside the inner case is supplied to the brush hair (hereinafter referred to as "brush").

However, the conventional cosmetic brush is figured to be exposed to the ambient without a protective part to cover it so that the cosmetic powder remaining in the brush falls down to the brush case and the brush is easily worn down or contaminated.

In the Korean Utility Model Application No. 15353 filed by the applicant of this invention on Jul. 29, 1999, there has been introduced a brush having a structure for containing the cosmetic powder inside the brush case and having a protective cap to cover the brush detachable therefrom, thereby to prevent the contamination or the wear-down. However, the brush still has a problem wherein the cosmetic powder inside the brush case is discharged from the case when the brush is not in use or sometimes the cosmetic powder is oversupplied to the skin while the brush is in use or overconsumed.

In an effort to solve the problems, the applicant filed another Korean Utility Model Application No. 21238 on Jul. 25, 2000, wherein the brush has a protective cap to protect the brush from the contamination or the wear-down while cutting off the discharge of the unwanted cosmetic powder during nonuse time. However, it still has a problem of causing the cosmetic powder to soil the hands of a user when detaching the protective cap and using the brush, and the like.

SUMMARY OF THE INVENTION

The present invention is directed to provide a cosmetic brush for preventing the contamination or the wear-down of the brush by a means to cover the brush while the brush is not in use and to be detachable when the brush is being used to address the above problems and provide more convenient application to those using the brush.

Another object of the present invention is to provide a cosmetic brush for discharging the cosmetic powder inside the brush to the outside only by the operation of pressing a pressure pump, and preventing the cosmetic powder from being excessively discharged when the brush is used again or from unnecessarily being discharged while being out of use.

A further object of the present invention is to provide a cosmetic brush for keeping the brush clean and conveniently holding the cosmetic powder thereinside by a simple operation avoiding any application of the powder to the user's hands.

To achieve these and other advantages related with the present invention, the cosmetic brush of the present invention comprises a cylinder, one end of which is open to contain cosmetic powder, and the other end of which has discharge holes to discharge the cosmetic powder, and is coupled with a connect cap to open/close the discharge holes and to guide the discharge of the cosmetic powder; a pressure pump being screw-coupled with the upper end of the cylinder, and injecting air to discharge the cosmetic powder in the cylinder into a brush; a guide tube being coupled with the cylinder at its upper end, and having two or more guide grooves in a spiral on its inner surface to guide the movement of two or more guide protrusions of the brush; a sliding tube having a slide aperture longitudinally formed in the surface of its upper part for receiving the brush inserted thereinside, the slide aperture being coupled with the guide protrusions of the brush, and the sliding tube being free to rotate with fitting into the guide tube; and a covering cap detachably coupled with the lower part of the sliding tube for covering and protecting the brush.

In the cosmetic brush of the present invention, it is preferable that one or more guide protrusions are formed on the outer circumferential surface of the cylinder having the discharge holes, and one or more guide grooves are formed on the inner circumferential surface of the connect cap, the guide protrusion and the guide groove being rotatably coupled with each other by force fitting.

Preferably, in the cosmetic brush of the present invention, a discharge pipe is formed on the connect cap extended from one surface of the connect cap, the discharge pipe passing through with the discharge hole on the bottom end of the cylinder and being inserted into the inside of the brush. Also, the cosmetic brush of the present invention is characterized in that the discharge pipe is formed to have a length to reach inside the brush to apply the cosmetic powder uniformly on the skin when a user is using the brush and to move forwardly to the tip-side of the brush by the moving-back of the cylinder and the brush when the brush is not in use and kept in.

In addition, a packing can be interiorly formed on the periphery of the inner surface of the connect cap to surround the periphery of the discharge hole of the cylinder.

It is preferable that the guide tube and the sliding tube are rotatably coupled with each other by force fitting.

Further, the cosmetic brush of the present invention may be preferably configured such that a fixing stop is formed on the both ends of the slide aperture of the sliding tube, respectively, and coupled with the guide protrusion of the brush to prevent further sliding movement of the brush by the longitudinally applied force on the brush and/or the sliding tube.

The concluding portion of this specification particularly points out and distinctly claims the subject matter of the present invention. However those skilled in the art will understand both the organization and method of operation of the invention, together with further advantages and objects thereof by reading the remaining portions of the specification in conjunction with the accompanying drawings.

DETAILED DESCRIPTION OF THE PREFERRED EMBODIMENTS

Now hereinafter, a detailed description of the preferable embodiment according to the present invention will be made referring to the accompanying drawings.

Figure 1:
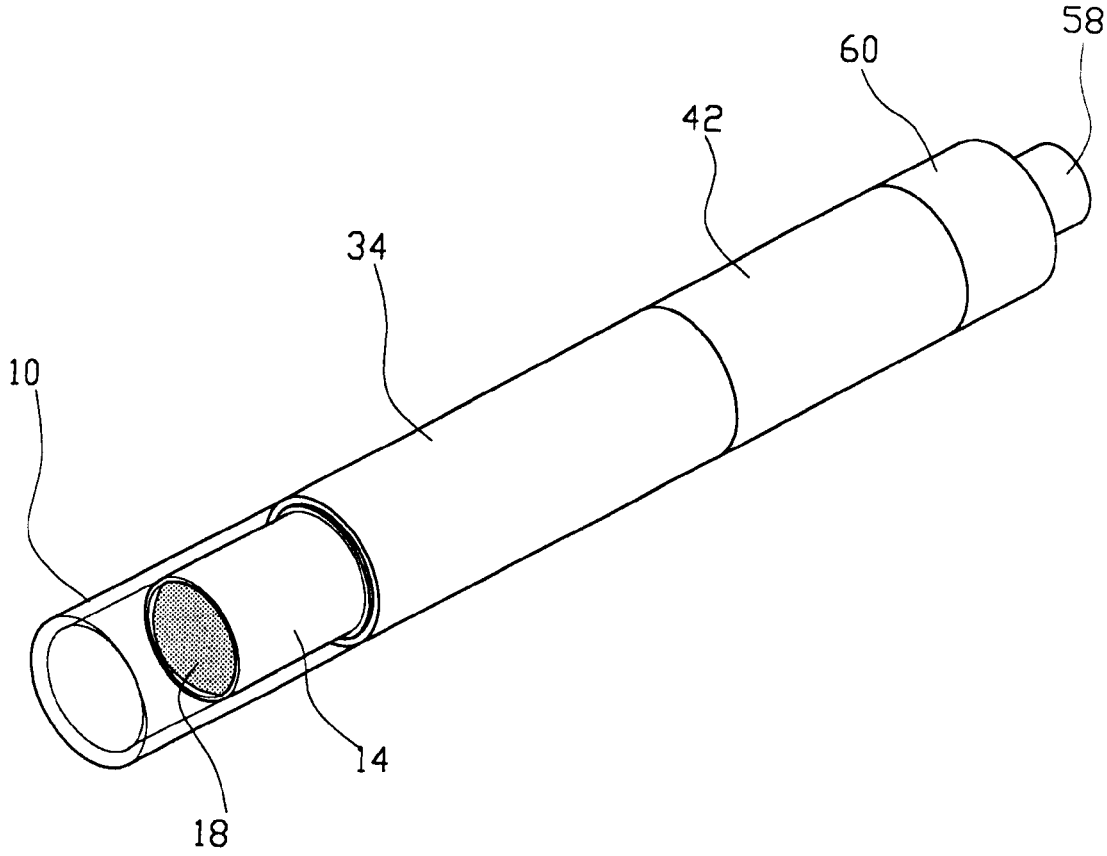
FIG. 1 is a perspective view of a cosmetic brush according to the present invention.
Figure 2:
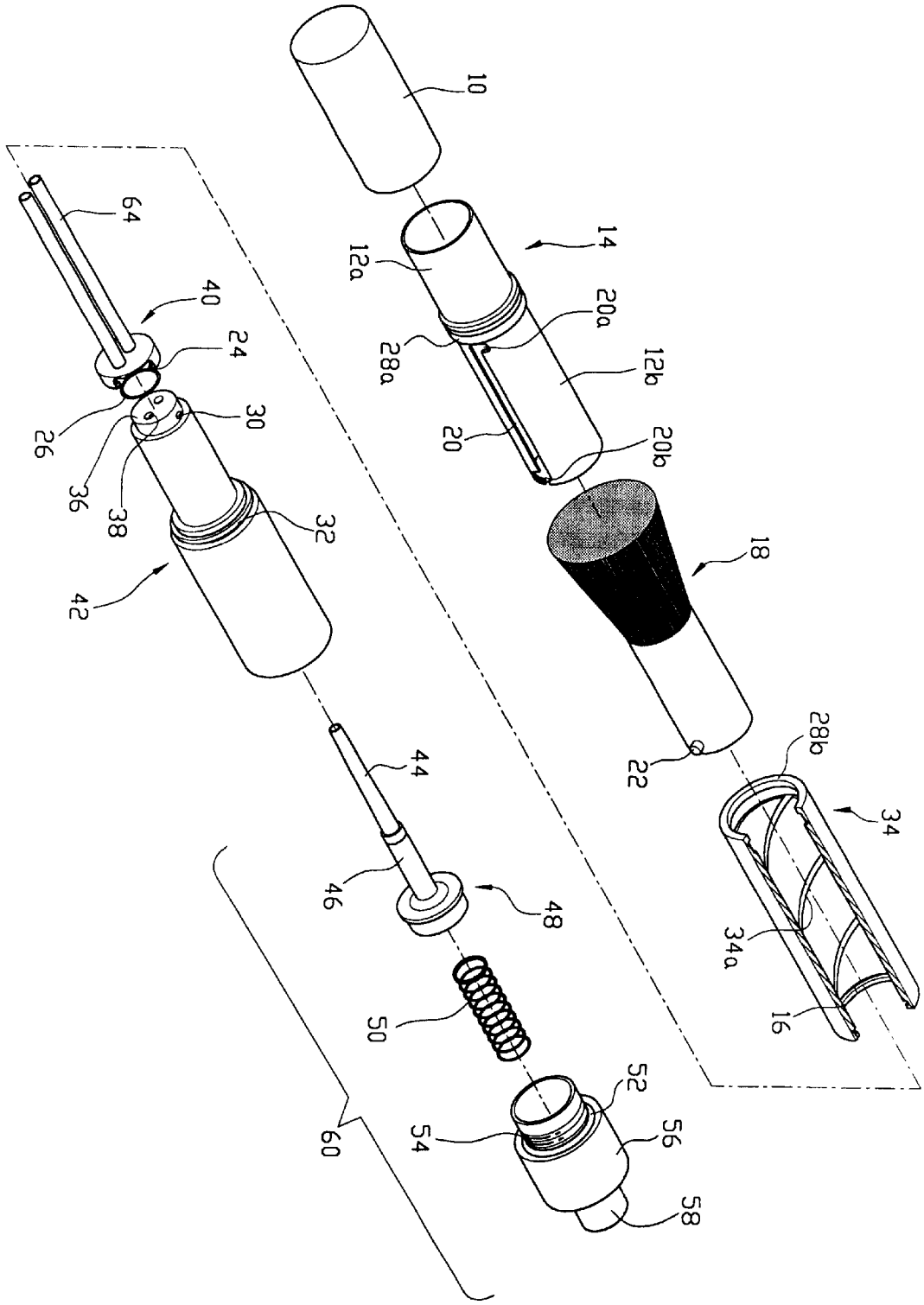
FIG. 2 is an exploded perspective view of a cosmetic brush according to the present invention.

FIGS. 1 and 2 are perspective views of a cosmetic brush according to the present invention. As shown in FIGS. 1 and 2, the cosmetic brush of the present invention comprises a brush 18; a sliding tube 14 having the brush 18 slidably installed therein; a guide tube 34 within the sliding tube 14 coupled with the guide tube 34 to be rotatable, and the guide tube 34 surrounding a part of the sliding tube 14 and the brush 18 for guiding the sliding of the brush 18; a cylinder 42 being coupled with the other side of the guide tube 34 and having the brush 18 inserted therein with a cosmetic powder contained therein; a pressure pump 60 coupled with an open one end of the cylinder 42; and a covering cap 10 for covering the brush 18, etc.

The brush 18 is composed of soft hairs being capable of directly contacting the skin of a user, and one end of the brush 18 is fixed on the cylinder 42. The brush 18 has a guide protrusion 22 on its circumferential surface to be coupled with a slide aperture 20 in the sliding tube 14 and a guide groove 34*a* in the guide tube 34.

The sliding tube 14 can be divided into a lower part 12*a* and an upper part 12*b*. The lower part 12*a* is exposed to the outside and capped with the covering cap 10, and the upper part 12*b* is inserted into the guide tube 34.

The sliding tube 14 has a coupling protrusion 28*a* in a ring shape on the interface of its lower part 12*a* and its upper part 12*b*. The coupling protrusion 28*a* is rotatably coupled with a corresponding coupling protrusion 28*b* in a ring shape formed on the inner circumferential surface of the guide tube 34. The lower part 12*b* of the sliding tube 14, which surrounds the brush 18, is inserted into the guide tube 34, and has the slide aperture 20 longitudinally formed in its side wall. Therefore, when the sliding tube 14 rotates while the brush 18 rotates together thereinside, the guide protrusion 22 of the brush 18 can ride in the guide groove 34*a* of the guide tube 34 and can move up along the slide aperture 20. Particularly, fixing stops 20*a*, 20*b* are formed on the both ends of the slide aparture 20 so that the brush 18 cannot slide upward any more even when the brush 18 and/or the sliding tube 14 get longitudinally pressed.

As such the above, the guide tube 34 having the guide groove 34*a* in its inner circumferential surface as a moving path for the brush 18, i.e., the guide protrusion 22 of the brush 18 is shaped to be open at its both ends. At both ends of the inner surface of the guide tube 34, there are formed coupling protrusions 28*b* and 16, which are forced to fit into and coupled with the coupling protrusion 28*a* of the sliding tube 14 and the coupling protrusion 32 of the cylinder 4, respectively. In other words, the sliding tube 14 rotates centering the guide tube 34 and controlling the sliding and the receipt of the brush 18 and the opening and shutting operation of the cylinder 42 to discharge the cosmetic powder.

The cylinder 42, which contains the cosmetic powder and discharges the cosmetic powder by the operation of the pressure pump 60, may be divided into parts, one of which has an outer diameter and can be inserted into the brush 18, another of which has an inner diameter and can be coupled with the guide tube 34, and another of which has the same diameter as the outer diameter of the guide tube 34, etc.

One end of the cylinder 42, i.e., the part having the greatest diameter, is open to be coupled with the pressure pump 60 and to be replenished with the cosmetic powder, the part of the middle diameter has the coupling protrusion 32 in round shape to be rotatably coupled with the coupling protrusion 16 of the guide tube 34. A connect cap 40 is rotatably coupled with the other end of the cylinder 42 by force fitting, and the connect cap 40 functions as a valve to control the discharge of the cosmetic powder by rotating itself through the discharge hole 38 formed on its bottom surface 36.

To help the function as a valve by rotation described as above, the connect cap 40 has a guide groove 24 formed on its inner circumferential surface. A guide protrusion 30 is formed on the outer circumferential surface of the cylinder 42 to be coupled with the guide groove 24 of the connect cap 40 by means of force fitting. In addition, a discharge pipe 64 is formed on the other end surface of the connect cap 40 to be extended to the inside of the brush 18 in assembling the above elements, which makes it possible for the cosmetic powder to be discharged from the cylinder 42 to reach the brush 18.

Figure 3A:
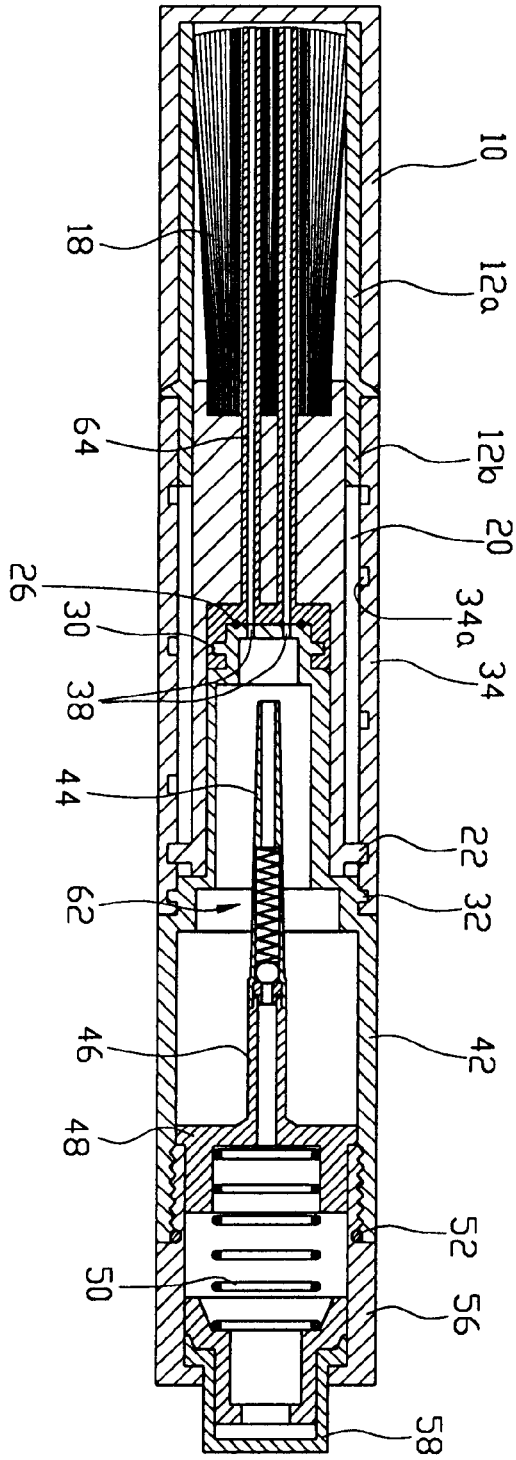
FIGS. 3*a* and 3*b* are sectional views of a cosmetic brush according to the present invention to show its operational state.
Figure 3B:
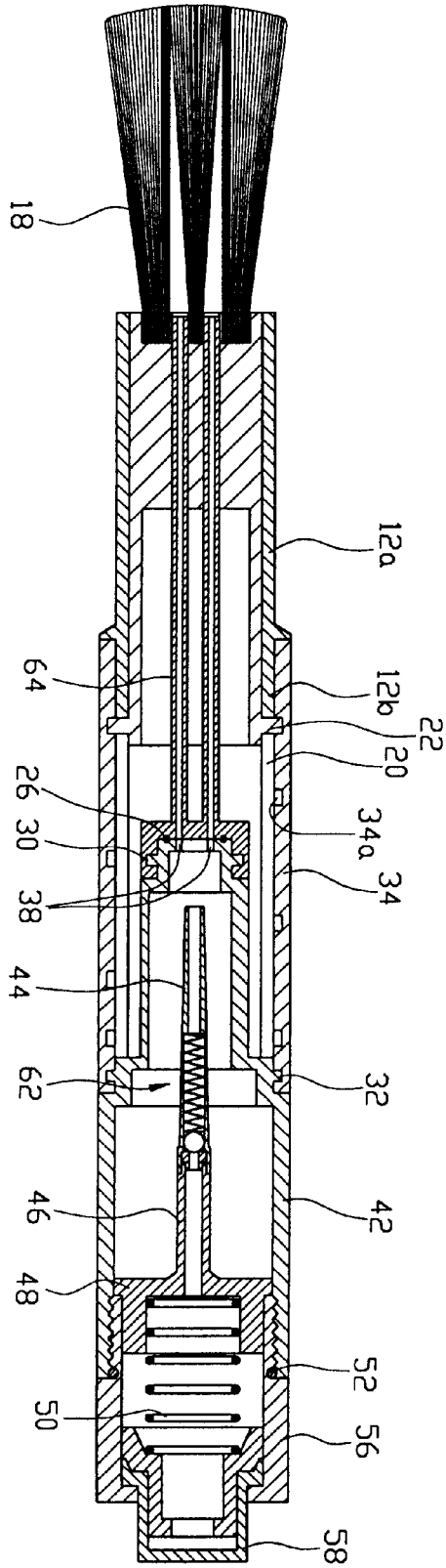

The discharge pipe 64, transferring the cosmetic powder to the brush 18, is constructed in such a manner that, as shown in FIG. 3*b*, the pipe 64 is placed inside the brush 18 to uniformly supply the cosmetic powder to the applied area without touching the skin of a user when she is doing a make-up, while the pipe 64 moves forwardly by the back-moving of the cylinder 42 and the brush 18 with a length to reach to the front of the brush 18 as shown in FIG. 3*a*. However, preferably, the tip of the discharge pipe 64 should not be exposed out of the brush 18, avoiding a hindrance to the covering cap 10, which covers the brush 18 to protect it.

Therefore, the cosmetic powder is not discharged to the brush 18 at all when the brush 18 is not in use because the discharge hole 38 on the bottom surface 36 and the discharge pipe 64 of the connect cap 40 can be completely crossed each other by the rotation of the sliding tube 14, which is the same even though the pressure pump 60 is operated or the brush 18 is shaken. However, when the brush 18 is in use, the discharge hole 38 on the bottom surface 36 and the discharge pipe 64 of the connect cap 40 remain open to each other, i.e., going through each other by the rotation of the sliding tube 14 so that the cosmetic powder is discharged to the brush 18 through the discharge pipe 64 by means of every operation of the pressure pump 60.

Particularly, since a packing 26 surrounding the periphery of the discharge hole 38 is installed inside the connect cap 40, the air pressure generated by the operation of the pressure pump 60 can be transferred through the discharge hole 38 of the bottom surface 36 into the discharge pipe 64 only, and the cosmetic powder can be supplied only to the brush 18 through the discharge pipe 64 without leakage of the cosmetic powder to the ambient.

The pressure pump 60 is coupled with the cylinder 42 by means of a screw part 54 formed on the outer circumferential surface of the pressure pump 60, which makes it possible to be coupled with the upper end of the cylinder 42. The pressure pump 60 is configured to further comprise a chamber 48 having a long round pipe 46 extended from its center, a rear end cap 56 covering the circumferential surface of one end of the chamber 48, and a push button 58, one end of which is inserted into the end of the rear end cap 56 and the other end of which is exposed to the ambient for supplying air pressure to the tube 44 formed to extend from the tip of the round pipe 46.

The tube 44 is coupled with the end of the round pipe 46 and is extended down to the discharge hole 38 in a long round-shaped pipe for supplying the cosmetic powder into the discharge hole 38 by means of the air pressure according to the pressure from the push button 58, a check valve 68 is installed inside the tube 44 to prevent the cosmetic powder from going back to the push button 58 through the tube 44 while the pressed push button 58 is returned to the original position and takes air in. The check valve 68 is constructed such that a ball is installed inside the tube 44, and a spring is provided with the ball to make the ball operate elastically.

A seal member is installed on the front end of the round pipe 46 of the chamber 48 to seal the round pipe 46 with closely adhered to the ball.

A spring 50 is installed between the chamber 48 and the push button 58 to make the pressed push button 58 return to its normal position. A packing lever in the same shape as the push button 58 is inserted inside the push button 58 with its lower end closely adhered to the inner circumferential surface of the rear end cap 56 to prevent leakage of air by sealing the interface of the push button 58 and the rear end cap 56. In addition, a ring-shaped packing 52 is installed between the cylinder 42 coupled with the pressure pump 60 and the rear end cap 56 to prevent leakage of the air pressure.

The cosmetic brush of the present invention having a structure as describe above can complete its assembly by putting the cosmetic powder into the cylinder 42, coupling the rear end cap 56 with one open end of the cylinder 42 for sealing, and sequentially coupling the guide tube 34, the sliding tube 14 and the brush 18 with the cylinder 42.

The cosmetic brush of the present invention, as shown in FIG. 3*a* is covered by the covering cap 10 to protect the brush 18 when the brush is not in use, and can change its shape as shown in FIG. 3*b,* when the covering cap 10 is removed and the sliding tube 14 is rotated while the guide tube 34 is held by a user, the guide protrusion 22 of the brush 18 moves along the guide groove 34*a* and the slide aperture 20 and the brush 18 is exposed out of the sliding tube 14 to spread its brush hair.

At this time, the connect cap 40 is rotated when the sliding tube 14 is rotated, and thus the discharge hole 38 of the cylinder 42 and the discharge pipe 64 of the connect cap 40 become aligned with each other.

Also, the air inside the sealed space is compressed when the push button 58 of the pressure pump 60 is pressed, and the compressed air moves forwardly through the round pipe 46 of the chamber 48 toward the tube 44 and opens the check valve 62, thereby to blow the cosmetic powder in the cylinder 42 toward the discharge hole 38 and the discharge pipe 64.

Meanwhile, even though the pressed check valve 62 comes back to its normal position when the push button 58 is returned to its normal position by the spring 50, it prevents the cosmetic powder from coming backwardly because it is closely adhered to the seal member installed on the end of the round pipe 46 of the chamber 48.

By the repeated pressing operation of the push button 58, a proper amount of the cosmetic powder can be supplied to the brush 18 through the discharge hole 38 and the discharge pipe 64 to be available to the user applying the brush while doing a make-up.

After the use of the brush is completed, if the sliding tube 14 is reversely rotated while the guide tube 34 is held by a user, the brush 18 hides its shape into the sliding tube 14 and the connect cap 40 is reversely rotated in the other direction so that the discharge hole 38 and the discharge pipe 64 are no longer aligned. Then, the lower part 12*a* of the sliding tube 14 is capped again by the covering cap 10 to prevent the cosmetic powder inside the cylinder 42 from unnecessarily being discharged to the brush which is not in use, and keep the brush away from any contaminants or abrasion.

As described above, according to the present invention, the brush can be protected from the abrasion or the contamination because the brush is kept covered with the covering cap and the sliding tube when it is not in use.

In addition, the cosmetic brush according to the present invention is constructed such that the cylinder having the refilled cosmetic powder and the pressure pump are screw-coupled to be easily detachable or assembled so that the cosmetic powder can be easily refilled and the inside of the cylinder can be easily cleaned.

Also, according to the cosmetic brush of the present invention, the discharge of an excessive amount of the cosmetic powder is prevented because the discharge of the cosmetic powder can be completely shut down by its structure and any unnecessary discharge of the powder can be prevented in advance. In addition, the cosmetic brush of the present invention provides a convenience to easily keep the brush in just by simple operation without powdering the skin.

While the present invention has been described with reference to a preferred embodiment, the description is illustrative of the invention and is not to be construed as limiting the invention. Various modifications to the preferred embodiment may be apparent to those skilled in the art without departing from the invention in its broader aspects. The appended claims therefore are intended to cover all such modifications as fall within the true scope and spirit of the invention.

What is claimed is:

1. A cosmetic brush comprising:

a cylinder, a first end of which is open to contain cosmetic powder, and a second end of which has discharge holes to discharge the cosmetic powder and is coupled with a connect cap to open/close the discharge holes and to guide the discharge of the cosmetic powder;

a pressure pump being screw-coupled with said first end of the cylinder, and injecting air to discharge the cosmetic powder in the cylinder into a brush having an external end and two or more guide protrusions;

a guide tube being coupled with the cylinder at a first end of said guide tube, and having two or more guide grooves in a spiral on its inner surface to guide movement of said guide protrusions of the brush;

a sliding tube having a slide aperture longitudinally formed in a surface of a first part of said sliding tube for receiving the brush inserted therein, the slide aperture being coupled with the guide protrusions of the brush, and the sliding tube being free to rotate with fitting into the guide tube; and a covering cap detachably coupled with a second part of the sliding tube for covering and protecting the brush.

2. The cosmetic brush according to the claim 1, wherein one or more guide protrusions are formed on an outer circumferential surface of the cylinder having the discharge holes, and one or more guide grooves are formed on an inner circumferential surface of the connect cap, the guide protrusion and the guide groove being rotatably coupled with each other by force fitting.

3. The cosmetic brush according to the claim 1, wherein a discharge pipe is formed on the connect cap extended from one surface of the connect cap, the discharge pipe is aligned with at least on of the discharge holes on said second end of the cylinder and being inserted into the brush.

4. The cosmetic brush according to the claim 3, wherein the discharge pipe is formed to have a length to reach inside the brush to apply the cosmetic powder uniformly on a skin portion of a user when a user is using the brush, and to move forwardly to an external end of the brush when the brush is out of use and kept in.

5. The cosmetic brush according to the claim 1, wherein a packing is interiorly formed on an inner surface of the connect cap to surround said discharge holes of the cylinder.

6. The cosmetic brush according to the claim 1, wherein the guide tube and the sliding tube are rotatably coupled with each other by force fitting.

7. The cosmetic brush according to the claim 1, wherein a fixing stop is formed on both ends of the slide aperture of the sliding tube, respectively and coupled with the guide protrusion of the brush to prevent the further sliding movement of the brush by a longitudinally applied force on the brush or the sliding tube.

8. A cosmetic brush comprising:

first means, a first end of which is open to contain cosmetic powder, and a second end of which has discharge holes to discharge the cosmetic powder and is coupled with a connect cap to open/close the discharge holes and to guide the discharge of the cosmetic powder;

pump means being screw-coupled with said first end of said first means, and injecting air to discharge the cosmetic powder in said first means into a brush having an external end and two or more guide protrusions;

guide means being coupled with said first means at a first end of said guide means, and having two or more guide grooves in a spiral on its inner surface to guide movement of said guide protrusions of the brush;

sliding means having a slide aperture longitudinally formed in a surface of a first part of said sliding means for receiving the brush inserted therein, the slide aperture being coupled with the guide protrusions of the brush, and said sliding means being free to rotate with fitting into said guide means; and covering means detachably coupled with a second part of said sliding means for covering and protecting the brush.

9. The cosmetic brush according to the claim 8, wherein one or more guide protrusions are formed on an outer circumferential surface of the first means having the discharge holes, and one or more guide grooves are formed on an inner circumferential surface of the connect cap, the guide protrusion and the guide groove being rotatably coupled with each other by force fitting.

10. The cosmetic brush according to the claim 8, wherein a discharge pipe is formed on the connect cap extended from one surface of the connect cap, the discharge pipe is aligned with at least one of the discharge holes on said second end of said first means and being inserted into the brush.

11. The cosmetic brush according to the claim 10, wherein the discharge pipe is formed to have a length to reach inside the brush to apply the cosmetic powder uniformly on a skin portion of a user when a user is using the brush, and to move forwardly to an external end of the brush when the brush is out of use and kept in.

12. The cosmetic brush according to the claim 8, wherein a packing is interiorly formed on an inner surface of the connect cap to surround said discharge holes of the first means.

13. The cosmetic brush according to the claim 8, wherein the guide means and the sliding means are rotatably coupled with each other by force fitting.

14. The cosmetic brush according to the claim 8, wherein a fixing stop is formed on both ends of the slide aperture of the sliding means, respectively, and coupled with the guide protrusion of the brush to prevent the further sliding movement of the brush by a longitudinally applied force on the brush or the sliding means.

* * * * *